US005839135A

United States Patent [19]

Kitamura

[11] Patent Number: 5,839,135

[45] Date of Patent: Nov. 24, 1998

[54] DEVICE FOR WASHING HUMAN BODY LYING ON STRETCHER

[75] Inventor: Teruo Kitamura, No.75-12, Uemetsu-cho, Hamamatsu-shi, 430, Japan

[73] Assignees: Teruo Kitamura; Aluvo Co., Ltd., both of Hamamatsu, Japan

[21] Appl. No.: 925,068

[22] Filed: Sep. 8, 1997

[51] Int. Cl.[6] ..... A47K 3/22

[52] U.S. Cl. ..... 5/606; 5/928; 4/597; 4/601; 4/604

[58] Field of Search ..... 5/606, 928; 4/538, 4/546, 555, 567, 568, 569, 571.1, 573.1, 596, 597, 601, 602, 604

[56] References Cited

U.S. PATENT DOCUMENTS 2,540,159 2/1951 Antrim ..... 4/601 X
3,613,127 10/1971 Bond ..... 4/597 X
4,055,863 11/1977 Duval ..... 4/601
4,970,736 11/1990 Koizumi ..... 4/597 X
5,136,735 8/1992 Zimmerman ..... 4/604 X
5,228,150 7/1993 Parker ..... 4/573.1 X

*Primary Examiner*—Michael F. Trettel
*Attorney, Agent, or Firm*—Nikaido, Marmelstein, Murray & Oram LLP

[57] ABSTRACT

A device for washing a user sitting in or reclining on a stretcher including an open-bottomed, double-walled housing defining a washing chamber therein and having a top wall opposite the open bottom, opposing side walls, a front wall and a rear opening opposite the front wall. A door is provided for opening and closing the rear opening and a plurality of nozzles are secured to an interior wall of the housing member for injecting warm water toward the user sitting in or reclining on the stretcher positioned in said washing chamber. The head of the user is located outside the washing chamber.

11 Claims, 6 Drawing Sheets

DEVICE FOR WASHING HUMAN BODY LYING ON STRETCHER

BACKGROUND OF THE INVENTION

This invention relates generally to a device for washing a body of a user, such as a patient, lying on a stretcher with a washing liquid injected through a plurality of shower nozzles.

A washing device is known which includes a longitudinally extending housing defining a washing chamber therein and provided with an opening at one longitudinal end thereof for introducing therethrough a user lying on a longitudinally extending, wheeled stretcher. An opening is also formed in each of the opposite side walls of the housing for permitting an assisting person to touch the user. A plurality of shower nozzles are provided on the ceiling of the housing to inject a washing liquid such as warm water toward the user.

The above washer has been found to have the following defects. Since the longitudinally extending stretcher on which the user lies is introduced into the washing chamber through the opening at one longitudinal end of the housing, the washer cannot be used in a small floor. Further, since the washing liquid is showered only downward, it is necessary to turn the user upside down in order to wash both sides of the body. Additionally, the temperature and the flow rate of the warm water discharged from the nozzles are apt to change when the water pressure of the city water is varied.

SUMMARY OF THE INVENTION

It is, therefore, an object of the present invention to provide a washing device which is devoid of the above-described defects of the conventional washer.

Another object of the present invention is to provide a washing device which requires only a small installation space.

It is a further object of the present invention to provide a washing device of the above-mentioned type, which can efficiently wash a user within a short period of time and which permits a stretcher on which a user lies to enter and exit the washing device through desired side.

There is provided in accordance with the present invention a device for washing a user, comprising:

a longitudinally extending stretcher having a longitudinal length sufficient for supporting the user lying thereon along the longitudinal direction thereof;

a housing member having a longitudinally extending top wall member and a pair of opposing, vertically extending front and rear wall members integrally connected to opposite longitudinal ends of said top wall member, respectively, for supporting said top wall member in a generally horizontal position, so that a washing chamber is defined by said top wall member and said front and rear wall members and so that a pair of opposite, side openings are defined at both side ends of said washing chamber, said front and rear wall members being spaced apart from each other such that said washing chamber has a longitudinal length greater than the longitudinal length of said stretcher;

upper and lower nozzles disposed within said washing chamber for injecting a washing liquid toward the user, lying in said stretcher positioned in said washing chamber, from upper and lower sides of said user;

a pair of shutters provided in respective side openings and each displaced between open and close position for opening and closing at least an upper part of the corresponding side opening; and a window provided in at least one of said shutters to permit an assisting person to see the user within said washing chamber through said window even when the corresponding shutter is in said closed position.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

Figure 1:
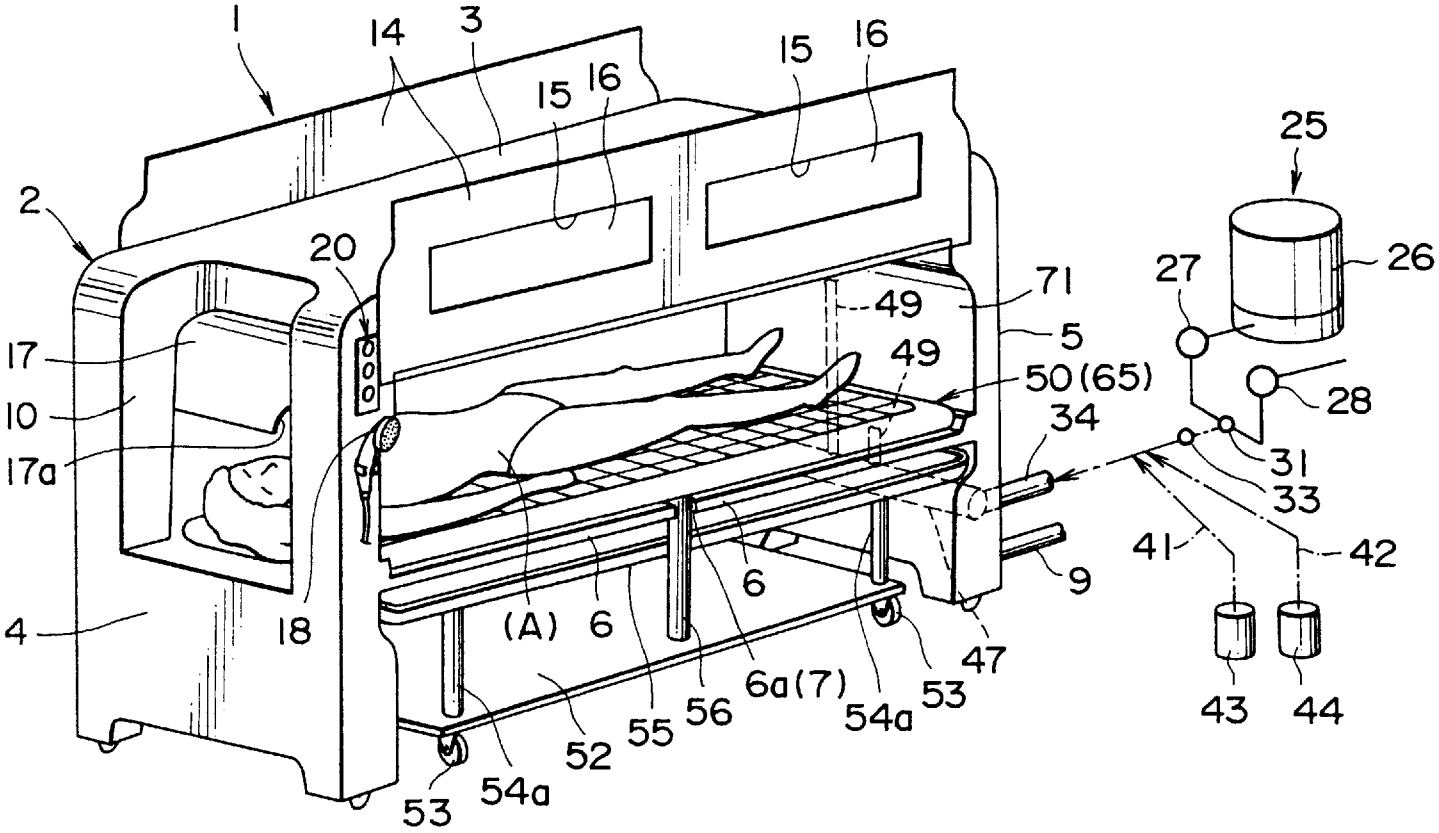
FIG. 1 is a perspective view diagrammatically showing one embodiment of a body washer according to the present invention.
Figure 2:
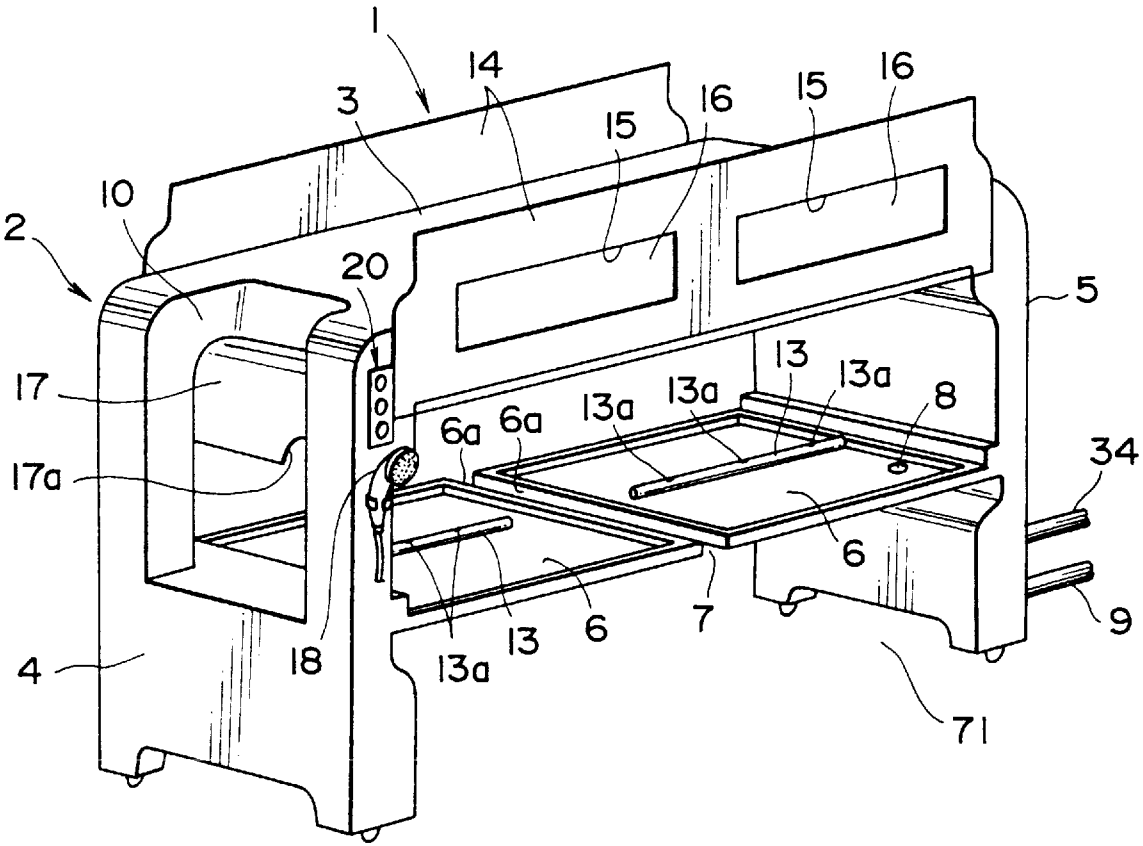
FIG. 2 is a perspective view of a body washer of FIG. 1 with a stretcher being removed therefrom.
Figure 3:
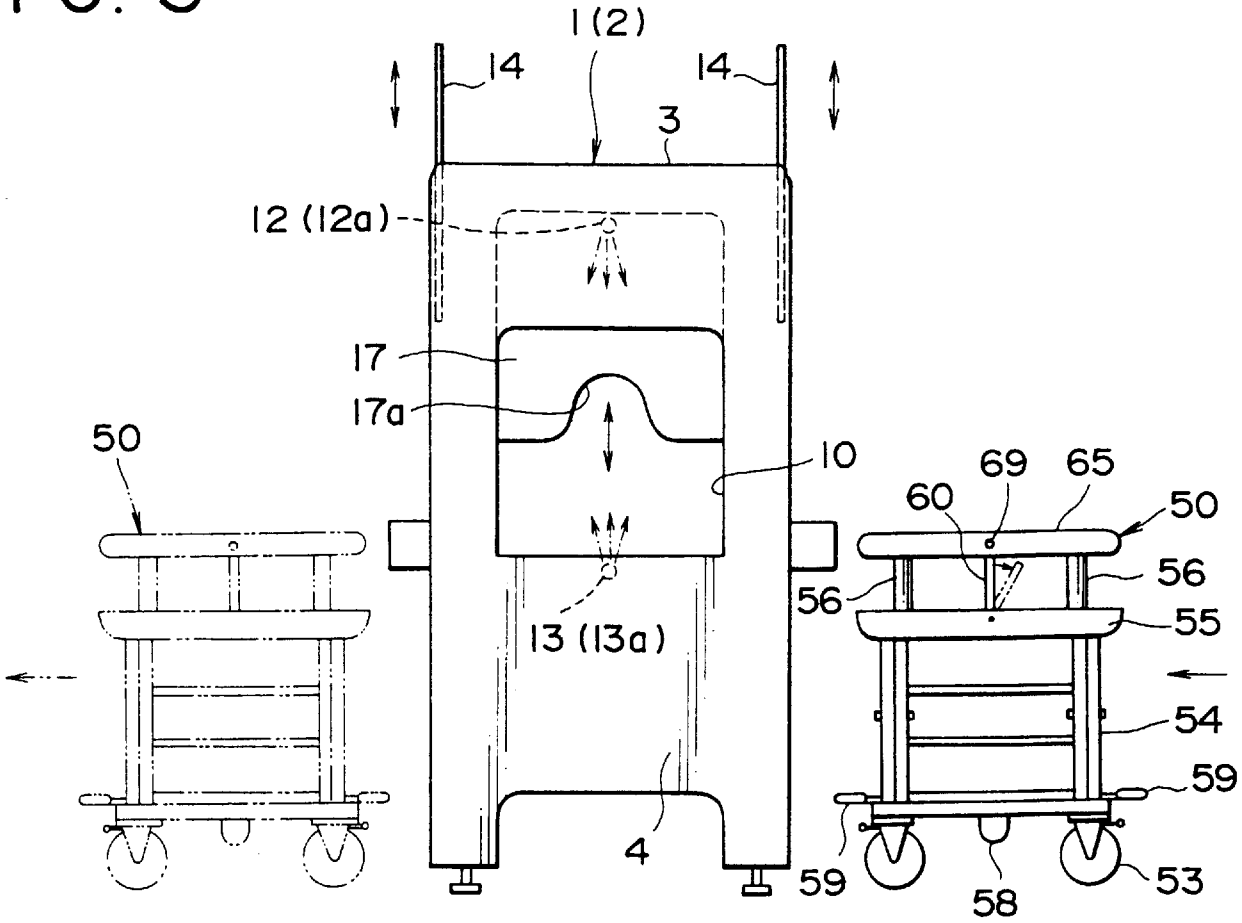
FIG. 3 is an elevational front view of the body washer of FIG. 1.

Referring now to FIGS. 1–3, designated generally as 1 is a washing device for washing a user (A) lying on a longitudinally extending stretcher 50 along the longitudinal direction thereof. The washing device 1 has a housing member 2 composed of a longitudinally extending top wall member 3 and a pair of opposing, vertically extending front and rear wall members 4 and 5 integrally connected to opposite longitudinal ends of the top wall member 3, respectively, for supporting the top wall member 3 in a generally horizontal position. The top wall member 3 and the front and rear wall members 4 and 5 define therewithin a washing chamber having a pair of opposite side openings 71. The front and rear wall members 4 and 5 are spaced apart from each other such that the washing chamber has a longitudinal length greater than the longitudinal length of the stretcher 50.

Disposed within the washing chamber are upper and lower nozzles 12*a* and 13*a* for injecting a washing liquid such as warm water toward the user (A), lying on the stretcher 50 in the washing chamber, from upper and lower sides of the user (A). A pair of shutters 14 are provided in respective sides of the washing chamber. Each of the shutters 14 is able to be displaced between open and close position for opening and closing at least an upper portion of the corresponding side opening 71. In the illustrated embodiment, each of the shutters 14 is vertically slidably secured to the housing 2 and adapted to close, in the closed position, an upper portion of the washing chamber to prevent the washing liquid from scattering out of the washing chamber. An open window 15 is provided in at least one of the shutters 14 to permit an assisting person to see and touch the user within the washing chamber through the window 15 even when the corresponding shutter is in the closed position. The window 15 is preferably provided with a curtain 16 made of a water-repelling opaque sheet to open and close the window 15.

A front end portion of the top wall member 3 and an upper end portion of the front wall member 4 are cut away to form a front opening 10, such that the face and head of the user (A) lying on the stretcher 50 can be positioned adjacent the front opening 10. A hand shower 18 is provided in the front wall member 4 to permit an assisting person to wash the head and the face of the user (A). Closure means 17 is provided for opening and closing the front opening 10. The closure means 17 in this embodiment is made from a flexible sheet having a U-shaped opening 17*a* into which the neck of the user (A) lying on the stretcher 50 placed in the washing chamber is fitted.

The upper nozzles 12*a* are provided along an upper feed pipe 12 longitudinally extending beneath the top wall member 3 and adapted for injecting and spraying the washing liquid downward. Similarly, the lower nozzles 13*a* are provided along lower feed pipes 13 longitudinally extending from the front and rear wall members 4 and 5 and adapted for injecting and spraying the washing liquid upward. The feed pipes 12 and 13 and the hand shower 18 are connected through valves to a feed pipe 34 as described hereinafter.

Disposed within the washing chamber are a pair of shallow dish-like front and rear shelf plates 6 horizontally extending throughout the lateral width of the washing chamber from the front wall member 4 and the rear wall member 5, respectively, and terminating at their ends 6*a* near the center of the washing chamber to define a laterally extending gap 7 therebetween. The gap 7 serves to function as a passage of the stretcher 50 as described hereinafter. As best seen in FIG. 2, each of the front and rear shelf plates 6 is disposed beneath the lower nozzles 13*a* and has a shallow depressed portion so that the washing liquid injected from the upper and lower nozzles 12*a* and 13*a* is received in the depressed portion of each of the front and rear shelf plates 6. The depressed portion of each of the shelf plates 6 has an opening 8 which is connected through a hose (not shown) to a discharge pipe 9 for discharging the washing liquid collected in the shelf plates 6. When the above-described shutters 14 are in the closed position, each of the lower ends thereof is generally located adjacent the shelf plates 6.

The stretcher 50 includes a wheeled support member 52 and a longitudinally extending net mat member 65 secured by vertically extending rod means 56 at a middle portion of thereof to the support member 52 for supporting the user (A) thereon, so that the stretcher 50 can enter the washing chamber from desired one of the side openings 71 with the rod means 56 passing through the lateral gap 7 and with the mat member 65 being located above the lower nozzles 13*a* and can exit the washing chamber from desired one of the side openings 71.

Figure 5:
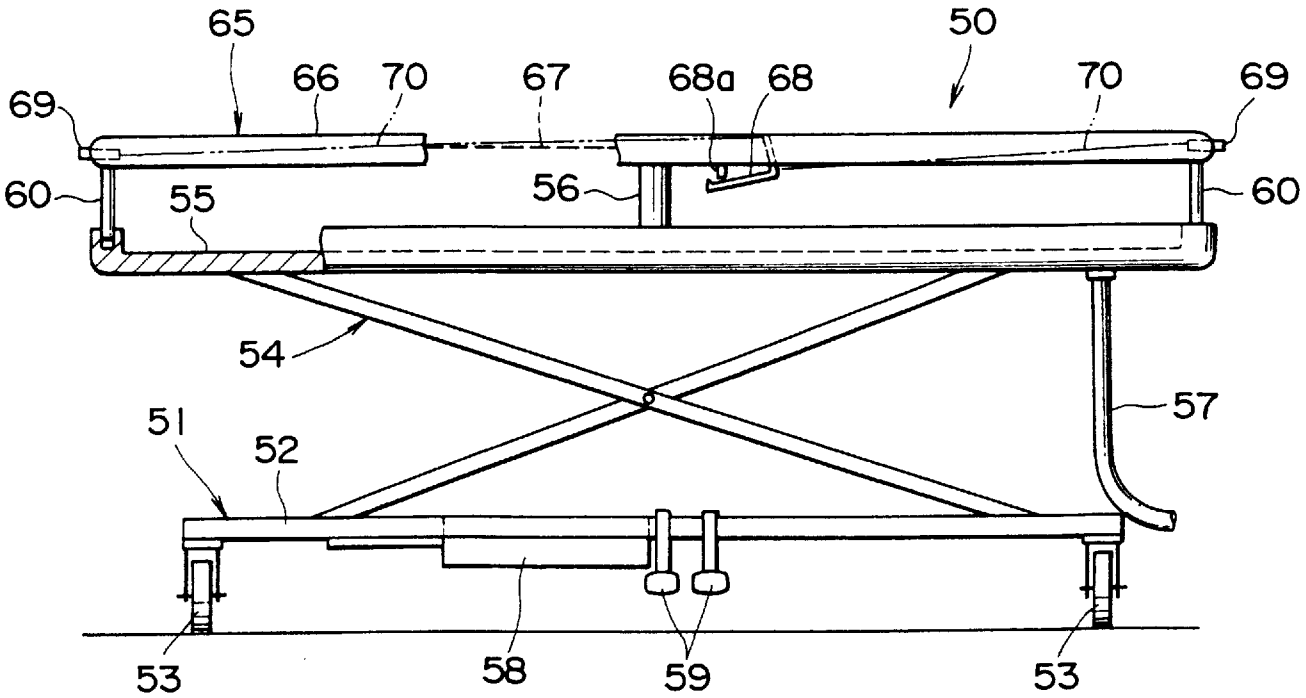
FIG. 5 is an elevational view of one embodiment of a stretcher.

One preferred embodiment of the stretcher 50 is illustrated in FIG. 5. In FIGS. 1 and 5, similar component parts are designated by the same reference numerals. Designated generally as 51 is a wheeled support member composed of a longitudinally extending base frame 52 and casters 53 secured to the underside of the base frame 52 so that the wheeled support member 51 is easily movable in any desired direction.

A dish-like plate 55 is horizontally secured to the base frame 51 by legs 54. In the embodiment shown in FIG. 5, the legs 54 are crossed and connected rotatably about a pin at the crossing point. The legs 54 have lower ends slidable in the longitudinal direction of the base frame 51 and secured thereto. Drive means such as a cylinder 58 is provided for displacing the lower ends of the legs 54, i.e. the crossing angle of the legs 54, so that the height of the dish-like plate 55 can be adjusted. Designated as 59 are pedals to actuate the cylinder 58 toward the extending and retracting directions. In the embodiment shown in FIG. 1, on the other hand, the dish-like plate 55 is fixedly secured to the base frame (wheeled support member) 52 by fixing legs 54*a*.

Referring again to FIG. 5, the rod means 56 are fixed on the dish-like plate 55 for supporting the mat member 65 thereon. As described previously, the rod means 56 are positioned at a center of the longitudinal direction of the support member 51, such that the rod means 56 can pass through the gap 7 defined between the shelf plates 6 when the stretcher 50 is introduced into the washing chamber. The height of the dish-like plate 55 is adjusted so that the shelf plates 6 is located between the mat member 65 and the dish-like plate 55, when the stretcher is placed in the washing chamber in the housing 2. Thus, the washing liquid injected from the nozzles 12*a* and 13*a* and falling through the gap 7 is received by the dish-like plate 55. The dish-like plate 55 has a bottom hole to which a flexible discharging hose 57 is connected.

Designated as 60 are auxiliary supporting rod members pivoted on the front and rear ends of the dish-like plate 55 and each normally biased in a vertical position by a spring (not shown) to support the mat member 65 thereon in a horizontal position. When the stretcher 50 is displaced to the washing chamber, the auxiliary supporting rod members 60 are pushed down by the shelf plates 6 to permit the stretcher 50 to enter the washing chamber. In the sate where the stretcher 50 is positioned in the washing chamber, the both front and rear ends of the mat member 65 are supported by a base portions of the shelf plates 6.

The mat member 65 is composed of a longitudinally elongated rectangular frame 66 and a net member 67 secured to the frame 66. The above-described rod means 56 and the auxiliary rod members 60 are secured to the frame 66. The net member 67 may be made of a high tensile strength fiber such as a polyester fiber and may be partly covered with a plastic sheet such as a polyvinyl chloride resin sheet. Alternatively, the net member 67 may be a perforated plastic sheet.

Designated as 69 are pins provided at front and rear ends of the frame 66 and each displaced between an extended position and a retracted position by operation of a handle 68 rotatably secured to the frame 66 near the center portion thereof. Each of the pins 69 is connected to the handle 68 through a wire 70. A spring 68*a* is connected to the handle 68 to normally hold the handle 68 in a first position where each of the pins 69 is maintained in the extended position. When the handle 68 is rotated (for example, downward) against the biasing force of the spring 68*a* from the first position to a second position, the pins are retracted to permit the entrance of the stretcher 50 in the washing chamber. After the stretcher 50 has been placed in position within the washing chamber, the handle 68 is released. Thus, the pins 69 are automatically moved to the extended position and are fitted into respective recesses (not shown) formed on the inside walls of the front and rear wall member, so that the stretcher 50 is prevented from displacing. By rotating the handle 68 to the second position, the pins 69 are disengaged from the recesses to permit the exit of the stretcher 50 from the washing chamber.

Figure 4:
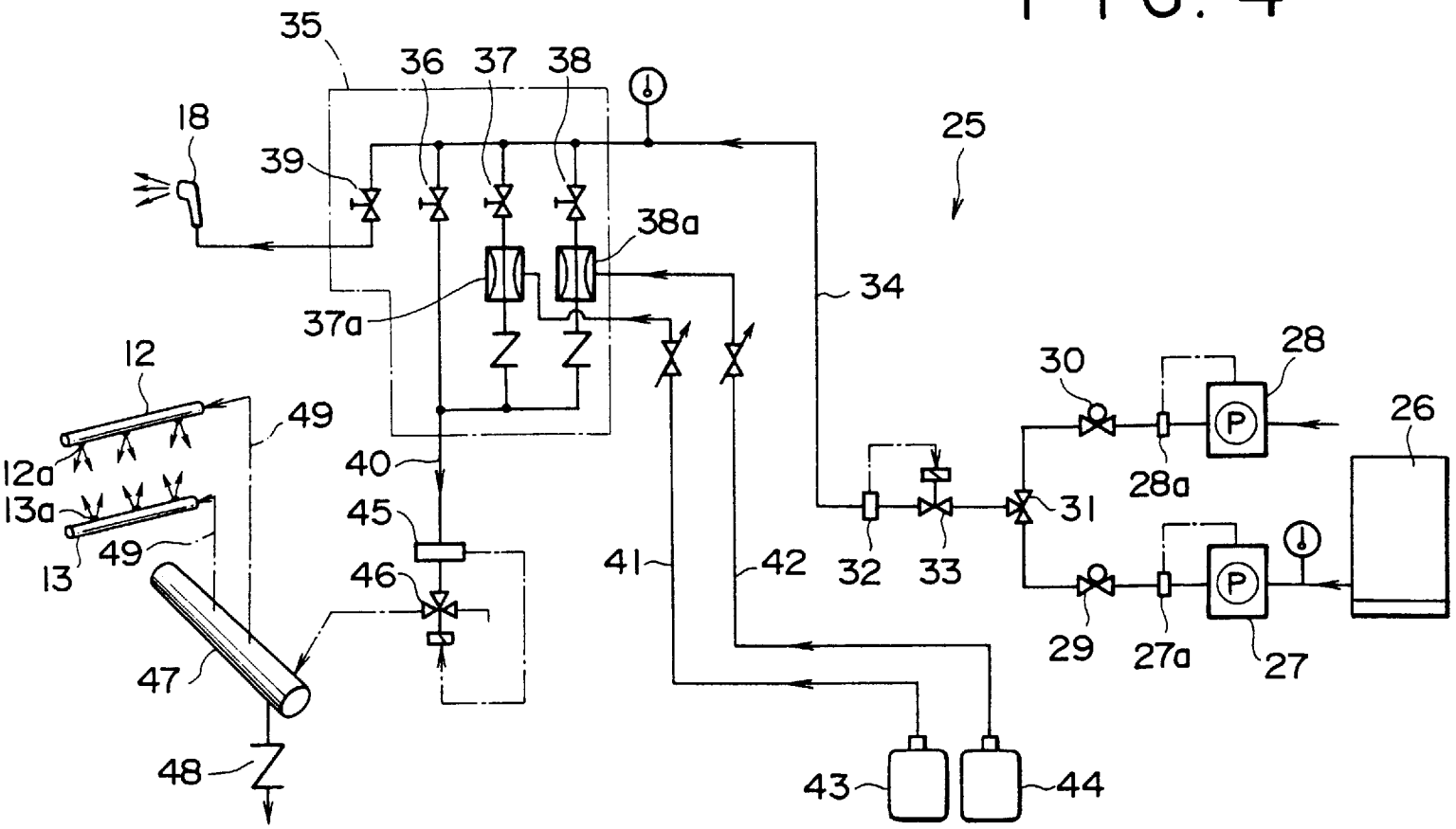
FIG. 4 is a diagram showing a pipe connection arrangement of the body washer of FIG. 1.

The above-mentioned feed tube 34 is connected to a warm water-supplying device 25 as shown in FIGS. 1 and 4. A first pump 27 is connected to a hot water source (boiler) 26 for increasing the pressure of hot water supplied thereto to a predetermined pressure of, for example, above 3.0 kg/cm$^2$, while a second pump 28 is connected to a water source for increasing the pressure of water supplied thereto to, for example, above 3 kg/cm$^2$. The pumps 27 and 28 are connected to pressure controlling valves 29 and 30, respectively, for controlling the pressure of the hot water fed from the first pump 27 and the pressure of the water fed from the second pump 28, respectively, to a predetermined pressure of, for example, 2.5 kg/cm$^2$. First and second flow switches 27*a* and 28*a* are interposed between the first pump 27 and the pressure controlling valve 29 and between the second pump 28 and the pressure controlling valve 30, respectively, and are operable to stop respective pumps 27 and 28 when the flow rate of the water and hot water passing therethrough exceeds a predetermined value.

Designated as 31 is a mixer connected to the pressure controlling valves 29 and 30 for mixing the water having a controlled pressure with the hot water having a controlled pressure in a suitable mixing ratio to obtain warm water having a predetermined temperature of, for example, about 43° C. The mixing ratio can be manually set as desired. The warm water is then fed through the feed pipe 34 to spray nozzles 12*a* and 13*a* and a hand shower 18.

A high temperature sensor 32 and a shut off valve (solenoid valve) 33 are disposed in the feed pipe 34. The sensor 32 is adapted for detecting the temperature of the warm water discharged from the mixer 31. When the temperature of the warm water detected by the sensor 32 exceeds a predetermined maximum value, for example 45° C., the shut off valve 33 electrically coupled to the sensor 32 is operated for stopping the passage of the warm water therethrough. The downstream of the shut off valve 33 is connected to a main tube 47 disposed in a lower portion of the rear wall member 5 of the housing member 2.

Referring still to FIGS. 1 and 4, at a side wall of an upper portion of the front wall member 4 of the housing member 2, there is provided an operation panel 20 including a valve mechanism 35. The valve mechanism has manual switching valves 36–39 connected in parallel to the feed pipe 34. The valve 36 is connected to the main tube 47 through a feed hose 40. The valves 37 and 38 have outlet sides connected through mixers 37*a* and 38*a* of an ejector type to the feed hose 40. The mixers 37*a* and 38*a* have respective suction ports connected to a sterilizing liquid tank 43 and a body shampoo tank 44 through suction hoses 41 and 42, respectively. When a selected one of the valves 37 and 38 is opened, the desired one of the sterilizing liquid and the shampoo is mixed with the warm water in the mixer 37*a* or 38*a* and the mixture is fed through the feed hose 40 to the main tube 47. The valve 39 is connected to a hand shower 18 through a flexible hose extending out of the housing member 2.

A low temperature sensor 45 and a switching valve 46 are disposed in the feed hose 40. The sensor 45 is adapted for detecting the temperature of the warm water passing therethrough. When the temperature of the warm water detected by the sensor 45 is below a predetermined minimum value, for example 37° C., the valve 46 electrically coupled to the sensor 45 is operated for switching the passage of the warm water from feed hose 40 to a discharge side. When the detected temperature is not lower than the minimum value, the switching valve 46 directs the warm water toward the main tube 47. The main tube 47 is connected to the upper and lower feed pipes 12 and 13 through flexible tubes 49.

An automatic discharging valve 48 of a spring-biased type is connected to the main tube 47 to release the warm water therefrom when the pressure therewithin is below a predetermined pressure. The automatic discharging valve 48 is closed by the pressure generated in the main tube 47 when the switching valve mechanism 35 is so shifted as to feed the warm water from the feed hose 40 to the main tube 47, thereby permit the warm water to be injected through the nozzles 12*a* and 13*a*. When the pressure within the main tube 47 is lowered to atmospheric pressure due to the close of the manual switching valve 36 or the shifting of the switching valve 46 to the discharge side, the automatic discharging valve 48 opens so that the warm water within the main tube 47, feed pipes 12 and 13 and the flexible pipes 49 is discharged therefrom through a drain pipe, since the nozzles 12*a* and 13*a* are in fluid communication with the atmosphere. Thus, since the retaining of the water in the main tube 47 and the flexible pipes 49 is prevented during the non-operating stage, the liquid initially injected from the nozzles 12*a* and 13*a* is not the water cooled during the retaining in the main tube 47 but is warm water freshly supplied through the feed pipes 34 and 40.

Figure 6:
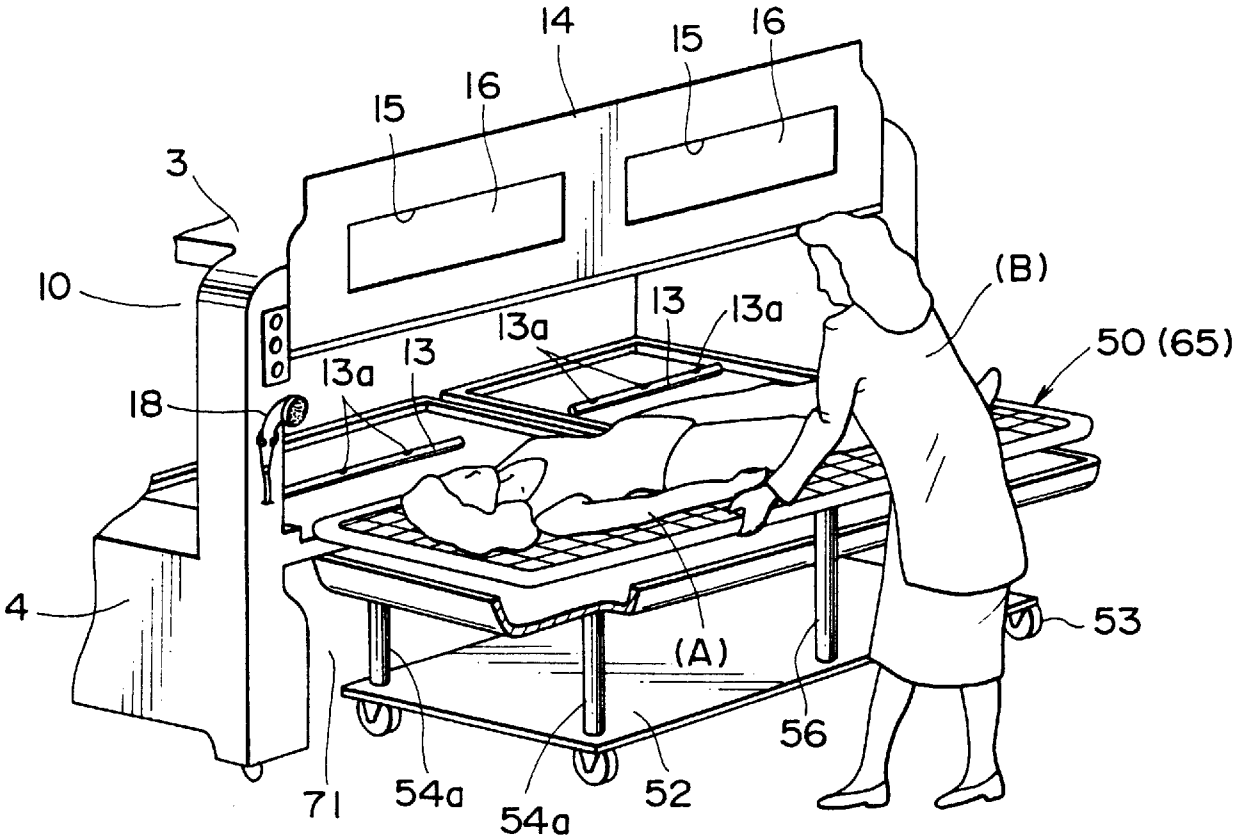
FIG. 6 is a perspective view similar to FIG. 1 showing the state where a user lying on a stretcher is introduced into the washing device.

The operation of the above washing device will be described below with reference to FIGS. 3 and 6. First, an assisting person (B) assists a user, such as a patient, (A) to lie on the mat 65 of the stretcher 50 along the longitudinal direction thereof. In the case of the stretcher shown in FIG. 5, the assisting person can adjust the height of the mat 65 by stepping the pedal 59. The assisting person (B) positions the stretcher 50 in parallel with the housing 2 and then pushes the stretcher in the washing chamber in the housing member 2. The side openings 71 and front opening 10 are then closed with the shutters 14 and the closure means 17, respectively. Thereafter, the assisting person (B) operates the operating panel to select the valve mechanism 35 as desired. Thus, warm water mixed with a shampoo or a sterilizing liquid, if desired, is then injected downward and upward from the upper and lower nozzles 12*a* and 13*a* to warm and wash the body of the patient (A). If necessary, the assisting person (B) washes the patient (A) by inserting the hand through the window 15. Using the hand shower 18, the face and head of the patient (A) protruded from the closure means 17 are washed.

After washing has been completed, the valve mechanism is stopped and the shutters 14 and 17 are moved upward. The assisting person (B) then moves the stretcher 50 to discharge the stretcher 50 from the washing chamber through desired one of the side openings 71. As soon as the stretcher 50 is discharged, another stretcher can be immediately introduced into the washing chamber through the other side opening 71.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A device for washing a user, comprising:

a longitudinally extending stretcher having a longitudinal length sufficient for supporting the user lying thereon along the longitudinal direction thereof;

a housing member having a longitudinally extending top wall member and a pair of opposing, vertically extending front and rear wall members integrally connected to opposite longitudinal ends of said top wall member, respectively, for supporting said top wall member in a generally horizontal position, so that a washing chamber is defined by said top wall member and said front and rear wall members and so that a pair of opposite, side openings are defined at both side ends of said washing chamber, said front and rear wall members being spaced apart from each other such that said washing chamber has a longitudinal length greater than the longitudinal length of said stretcher;

upper and lower nozzles disposed within said washing chamber for injecting a washing liquid toward the user, lying in said stretcher positioned in said washing chamber, from upper and lower sides of said user;

a pair of shutters provided in respective side openings and each displaced between open and close position for opening and closing at least an upper part of the corresponding side opening; and a window provided in at least one of said shutters to permit an assisting person to touch the user within said washing chamber through said window even when the corresponding shutter is in said closed position.

2. A device as claimed in claim 1, wherein a front end portion of said top wall member and an upper end portion of said front wall member are cut away to form a front opening, so that an assisting person can touch the face and head of the user located within said washing chamber with the head thereof being positioned in the front side of said stretcher.

3. A device as claimed in claim 2, further comprising a hand shower for washing the head of the user.

4. A device as claimed in claim 3, further comprising closure means for closing said front opening, said closure means having a U-shaped opening into which the neck of the user lying on said stretcher placed in said washing chamber is fitted.

5. A device as claimed in claim 1, further comprising front and rear shelf plates horizontally extending from said front wall member and said rear wall member, respectively, and terminating near the center of said washing chamber to define a laterally extending gap therebetween, each of said front and rear shelf plates being disposed beneath said lower nozzles and having a shallow depressed portion so that the washing liquid injected from said upper and lower nozzles is received in said depressed portion of each of said front and rear shelf plates, wherein said stretcher includes a wheeled support member and a longitudinally extending net mat member for supporting the user thereon and secured to said support member through a vertically extending rod means at a middle portion of said mat member, so that said stretcher can enter said washing chamber from a desired one of said side openings with said rod means passing through said lateral gap and with said mat member being located above said lower nozzles and can exit said washing chamber from a desired one of said side openings.

6. A device as claimed in claim 5, wherein said stretcher comprises auxiliary supporting rod members pivoted on said wheeled support member and each normally biased in a vertical position to support said mat thereon, so that when said stretcher is displaced into said washing chamber, said auxiliary supporting rod members are pushed down by said shelf plates to permit said stretcher to enter said washing chamber.

7. A device as claimed in claim 5, wherein said stretcher comprises a dish-like plate secured to said wheeled support member and horizontally disposed below said mat, so that the washing liquid injected from said nozzles and falling through said gap is received by said dish-like plate.

8. A device as claimed in claim 1, further comprising first pump means to be connected to a water source for increasing the pressure of water supplied thereto, first controlling means connected to said first pump means for controlling the pressure of the water fed from said first pump means, second pump means to be connected to a hot water source for increasing the pressure of hot water supplied thereto, second controlling means connected to said second pump means for controlling the pressure of the hot water fed from said second pump means, a mixer connected to said first and second controlling means for mixing the water having a controlled pressure with the hot water having a controlled pressure to obtain warm water having a predetermined temperature, and pipe means for feeding the warm water having the predetermined temperature to said upper and lower nozzles as said washing liquid.

9. A device as claimed in claim 8, further comprising a high temperature sensor connected to said pipe means for detecting the temperature of the warm water, and a shut off valve disposed in said pipe means and coupled to said high temperature sensor for stopping the passage of the warm water therethrough when the temperature detected by said high temperature sensor exceeds a predetermined temperature.

10. A device as claimed in claim 9, further comprising a low temperature sensor connected to said pipe means at a position downstream of said high temperature sensor for detecting the temperature of the warm water, and a switching valve disposed in said pipe means and coupled to said low temperature sensor for directing the passage of the warm water to said plurality of nozzles when the temperature detected by said low temperature sensor is not lower than a predetermined temperature and to a discharge side when the temperature detected by said low temperature sensor is below said predetermined temperature.

11. A device as claimed in claim 8, further comprising an automatic discharging valve connected to said pipe means and adapted to automatically operate to release the warm water from said pipe means when the pressure within said main tube is below a predetermined pressure.

* * * * *